US007951287B2

(12) United States Patent
Miller et al.

(10) Patent No.: US 7,951,287 B2
(45) **Date of Patent: *May 31, 2011**

(54) PRODUCTION OF LOW SULFUR, MODERATELY AROMATIC DISTILLATE FUELS BY HYDROCRACKING OF COMBINED FISCHER-TROPSCH AND PETROLEUM STREAMS

(75) Inventors: Stephen J. Miller, San Francisco, CA (US); Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1168 days.

This patent is subject to a terminal disclaimer.

(21) Appl. No.: 11/019,460

(22) Filed: Dec. 23, 2004

(65) Prior Publication Data

US 2006/0138022 A1 Jun. 29, 2006

(51) Int. Cl.
*C10L 1/04* (2006.01)
*C10L 1/08* (2006.01)

(52) U.S. Cl. ..... 208/15; 208/24; 208/950; 585/15; 44/436

(58) Field of Classification Search ..... 208/15; 585/14; 44/300
See application file for complete search history.

(56) References Cited

U.S. PATENT DOCUMENTS

| | | | | |
|---|---|---|---|---|
| 3,149,993 | A | 9/1964 | Ley et al. | |
| 3,852,207 | A | 12/1974 | Stangeland et al. | |
| 3,904,513 | A | 9/1975 | Fischer et al. | |
| 4,157,294 | A | 6/1979 | Iwao et al. | |
| 4,320,020 | A | 3/1982 | Lange | |
| 4,320,021 | A | 3/1982 | Lange | |
| 4,347,121 | A | 8/1982 | Mayer et al. | |
| 4,347,148 | A | 8/1982 | Davis | |
| 4,386,939 | A | 6/1983 | Lange | |
| 4,507,517 | A | 3/1985 | Devries et al. | |
| 4,568,663 | A | 2/1986 | Mauldin | |
| 4,599,474 | A | 7/1986 | Devries et al. | |
| 4,704,487 | A | 11/1987 | Devries et al. | |
| 4,704,493 | A | 11/1987 | Devries et al. | |
| 4,709,108 | A | 11/1987 | Devries et al. | |
| 4,734,537 | A | 3/1988 | Devries et al. | |
| 4,810,357 | A | 3/1989 | Chester et al. | |
| 4,814,533 | A | 3/1989 | Devries et al. | |
| 4,814,534 | A | 3/1989 | Devries et al. | |
| 4,814,538 | A | 3/1989 | Devries et al. | |
| 5,689,031 | A | 11/1997 | Berlowitz et al. | |
| 5,766,274 | A | 6/1998 | Wittenbrink et al. | |
| 6,017,372 | A | 1/2000 | Berlowitz et al. | |
| 6,162,956 | A | 12/2000 | Berlowitz et al. | |
| 6,180,842 | B1 | 1/2001 | Berlowitz et al. | |
| 6,274,029 | B1 | 8/2001 | Wittenbrink et al. | |
| 6,296,757 | B1 | 10/2001 | Wittenbrink et al. | |
| 6,299,758 | B1 * | 10/2001 | Okazaki et al. | 208/15 |
| 6,309,432 | B1 | 10/2001 | Wittenbrink et al. | |
| 6,607,568 | B2 | 8/2003 | Wittenbrink et al. | |
| 6,663,767 | B1 * | 12/2003 | Berlowitz et al. | 208/15 |
| 6,755,961 | B1 * | 6/2004 | Berlowitz et al. | 208/15 |
| 6,776,897 | B2 | 8/2004 | Bacha et al. | |
| 6,797,154 | B2 * | 9/2004 | Mukherjee et al. | 208/58 |
| 6,833,484 | B2 * | 12/2004 | O'Rear | 585/1 |
| 6,846,402 | B2 | 1/2005 | Hemighaus et al. | |
| 6,860,909 | B2 * | 3/2005 | Berlowitz et al. | 44/436 |
| 6,933,323 | B2 * | 8/2005 | O'Rear et al. | 518/700 |
| 7,179,311 | B2 * | 2/2007 | O'Rear et al. | 44/412 |
| 7,179,364 | B2 * | 2/2007 | O'Rear et al. | 208/15 |
| 7,285,693 | B2 * | 10/2007 | Clark | 585/1 |
| 7,345,210 | B2 * | 3/2008 | Maund et al. | 585/14 |
| 7,374,657 | B2 * | 5/2008 | Miller et al. | 208/14 |
| 7,384,536 | B2 * | 6/2008 | Rosenbaum et al. | 208/18 |
| 7,402,237 | B2 * | 7/2008 | McCoy et al. | 208/128 |
| 7,404,888 | B2 * | 7/2008 | O'Rear et al. | 208/17 |
| 2002/0169218 | A1 | 11/2002 | Moore et al. | |
| 2003/0085153 | A1 | 5/2003 | O'Rear | |
| 2003/0116469 | A1 | 6/2003 | Hemighaus | |
| 2004/0152930 | A1 | 8/2004 | O'Rear | |

FOREIGN PATENT DOCUMENTS

| | | |
|---|---|---|
| EP | 0609079 A1 | 8/1994 |
| WO | 03/035806 | 5/2003 |
| WO | 2004/113474 | 12/2004 |

OTHER PUBLICATIONS

International Search Report dated Jul. 25, 2006.
Netherlands Search Report dated Oct. 24, 2006.
U.S. Appl. No. 11/019,455, "Production of Low Sulfur, Moderately Aromatic Distillate Fuels by Hydrocracking of Combined Fischer-Tropsch and Petroleum Streams", Miller et al., filed Dec. 23, 2005.
U.S. Appl. No. 10/464,546, "Stable, Moderately-Aromatic Distillate Fuel Blend Stocks Prepared by Low Pressure Hydroprocessing of FT Products", Miller et al., filed Jun. 17, 2003.
U.S. Appl. No. 10/464,635, "Stable, Moderately Unsaturated Distillate Fuel Blend Stocks Prepared by Low Pressure Hydroprocessing of FT Products", Miller et al., filed Jun. 17, 2003.
Technical Review, Diesel Fuels, Chevron Products Company, pp. 27-30, 31, 34, 35, 36, 55-64 (2000).
Vardi, J. et al., "Peroxide Formation in Low Sulfur Automotive Diesel Fuels", SAE Paper 920826, Feb. 1992.
California Governer's"Diesel Fuel Task Force Final Report", Mar. 29, 1996.

* cited by examiner

*Primary Examiner* — Ellen M McAvoy
(74) *Attorney, Agent, or Firm* — Merchant & Gould

(57) ABSTRACT

The present invention relates to distillate fuels or distillate fuel blend stocks comprising a blend of a Fischer-Tropsch derived product and a petroleum derived product that is hydrocracked under conditions to preserve aromatics. The resulting distillate fuel product is a low sulfur, moderately aromatic distillate fuel. The resulting distillate fuel or distillate fuel blend stock exhibits excellent properties, including good seal swell, density, and thermal stability. The present invention also relates to processes for making these distillate fuels or distillate fuel blend stocks.

26 Claims, No Drawings

PRODUCTION OF LOW SULFUR, MODERATELY AROMATIC DISTILLATE FUELS BY HYDROCRACKING OF COMBINED FISCHER-TROPSCH AND PETROLEUM STREAMS

FIELD OF THE INVENTION

The present invention relates to distillate fuels or distillate fuel blend stocks that have improved seal swell properties and processes for making these distillate fuels or distillate fuel blend stocks. More particularly, the present invention relates to a blended distillate fuel, or distillate fuel blend stock, comprising a hydrocracked blend of a Fischer-Tropsch derived wax and a petroleum derived vacuum gas oil (VGO).

BACKGROUND OF THE INVENTION

Distillate fuels produced from Fischer Tropsch products (i.e., waxes and condensates) by hydroprocessing (hydrotreating, hydrocracking, hydroisomerization, and related processes) have excellent cetane numbers, and very low sulfur and aromatic content. These properties make Fischer Tropsch products generally suitable for use as a fuel where environmental concerns are important. However, due to their high paraffin and low aromatic contents, Fischer-Tropsch distillate fuels have certain properties that are problematic when used as a fuel.

By way of example, Fischer-Tropsch distillate fuels have problems with poor seal swell properties. The seal swell problems associated with Fischer-Tropsch distillate fuel components may limit their use.

The impact of lowering the aromatic content of distillate fuels used as diesel fuel or jet fuel on seal swell in diesel and jet engines is known, and became important when California switched from conventional diesel fuel to Low Aromatics Diesel Fuel (LAD). LAD does not contain zero aromatics, but must contain less than 10%. Literature references related to the problems encountered with lowering the aromatic content of distillate fuels include: Transport Topics, National Newspaper of the Trucking Industry, Alexandria, Va., "Fuel Pump Leaks Tied to Low Sulfur," Oct. 11, 1993; Oil Express, "EPA's diesel rules leading to shortages, fleet problems, price hikes," Oct. 11, 1993, p 4; Marin Independent Journal, "Motorists in Marin angry over fuel change," Nov. 11, 1993, p A1; San Jose Mercury News, "Mechanics finger new diesel fuel," Dec. 3, 1993; and San Francisco Chronicle, "Problems With New Diesel Fuel, Clean Air, Angry California Drivers," Dec. 23, 1993.

The problem of poor seal swell may be monitored by measuring the swelling of gaskets. The swelling of gaskets can be monitored by the use of known tests. For example, a description of test methodology is presented in SAE Paper No. 942018, "Effect of Automotive Gas Oil Composition on Elastomer Behavior," October 1994, which describes seal swell and hardness changes which were measured in test procedures, based as closely as possible, on a British Standard (BS) method BS 903 Part A 16 [British Standard Institute, 'Methods for testing vulcanized rubber,' Part A 16:1987—Determination of the effect of liquids], which is broadly similar to American Society for Testing and Materials (ASTM) procedures D471 [Test Method for Rubber Property-Effect of Liquids] and D2240 ["Test Method for Rubber Property-Durometer Hardness]." (See FIG. 12). The paper examines volume swelling of five types of elastomers: hydrogenated nitrile, low nitrile, medium nitrile and low nitrile rubbers, and fluorocarbon elastomer.

A summary of work carried out to assess problems associated with California low sulfur/low aromatics fuels is presented in the California Governor's "Diesel Fuel Task Force Final Report," dated Mar. 29, 1996. The report notes results of measurements carried out on O-rings before and after immersion in fuels: volume and weight change by ASTM D471 [Test Method for Rubber Property-Effect of Liquids], hardness by ASTM D1415 [Test Method for Rubber Property-International Hardness], and modulus of elasticity, ultimate tensile strength and elongation by ASTM D1414 [Test Methods for Rubber O-Rings].

In addition to problems with seal swell, highly paraffinic fuels have low densities in comparison to specifications of standard fuels. Lower densities are an important concern with jet fuels because jet fuels with low densities give decreased range of flight. In addition, with diesel fuels low densities are expected to give low driving ranges and likely lead to customer dissatisfaction. The following Table I summarizes the densities of some paraffins in the distillate boiling range.

TABLE I

Densities of Paraffins in the Distillate Boiling Range

| Paraffin | Cetane No. | Density, g/cm$^3$ at 20° C. | Net Heat of Combustion, BTU/Gal | Net Heat of Combustion, MJ/kg |
|---|---|---|---|---|
| n-Paraffins | | | | |
| Decane (n-$C_{10}H_{22}$) | 76 | 0.7301 | 115,880 | 44.25 |
| n-Pentadecane (n-$C_{15}H_{32}$) | 95 | 0.7684 | 121,250 | 43.99 |
| n-hexadecane (n-$C_{16}H_{34}$) | 100 | 0.7735 | 122,000 | 43.95 |
| Eicosane (n-$C_{20}H_{42}$) | 110 | 0.7843 | 123,440 | 43.87 |
| i-Paraffins | | | | |
| 2-methylheptane (i-$C_8H_{18}$) | | 0.6979 | 111,110 | 44.38 |
| 2,2-Dimethyloctane (i-$C_{10}H_{22}$) | | 0.7245 | 114,750 | 44.16 |
| 2-methyludecane (i-$C_{12}H_{26}$) | | 0.7475 | 117,900 | 44.08 |
| Aromatics | | | | |
| p-xylene ($C_8H_{10}$) | | 0.8610 | 128,900 | 40.81 |
| n-nonylbenzene ($C_{15}H_{24}$) | 50 | 0.8558 | 129,410 | 42.15 |
| n-decylbenzene ($C_{16}H_{26}$) | | 0.8554 | 129,600 | 43.95 |
| n-tetradecylbenzene ($C_{20}H_{34}$) | 72 | 0.8549 | 130,310 | 42.50 |

According to ASTM D 1655 specifications for jet fuel, the range of acceptable densities at 15° C. for Jet A and Jet A-1 is 775-840 kg/m$^3$ (0.775 to 0.840 g/cm$^3$). Thus, pure n-paraffins appear to have unacceptably low densities. Isomerization of the paraffins, critical to meeting cold climate specifications such as pour, cloud and freeze points, often slightly lowers their densities even further making their fit with the minimum requirements of acceptable densities even poorer. Adjusting of the above listed densities for a temperature of 15° C. will typically only increase the densities by 0.004 g/cm$^3$; therefore, these conclusions will not be changed significantly. Lower densities are an important concern because jet fuels with low densities give decreased range of flight.

In the United States, ASTM D975 sets the specifications for diesel fuel; however, it does not include specifications for density or energy content of diesel fuel. However, as noted in "Technical Review, Diesel Fuels, Chevron Products Company," (FTR-2, 1998), Page 31, typical low sulfur fuels have relative densities between 0.83 and 0.86 g/cm$^3$ at 15° C., and typical net heating contents of 130,000 Btu/Gallon. Corresponding values for paraffins (both normal and iso) are below these cited typical values. Thus, highly paraffinic diesel fuels are expected to give low driving ranges and likely lead to customer dissatisfaction.

The National Conference on Weights and Measures (NCSM) provides a definition for "premium diesel fuel." ("Technical Review, Diesel Fuels, Chevron Products Company," (FTR-2, 1998), Pages 35-36). Part of the specifications for this premium diesel fuel includes a minimum gross energy content of 138,700 Btu/gal, which is equivalent to a minimum net energy content of 130,500 Btu/gal. Aromatics come closest to this limit for minimum gross energy. Therefore, pure paraffinic diesel fuels will have densities and energy contents below the typical ranges of fuels, and below the emerging specifications for premium fuels.

An additional problem associated with highly paraffinic distillate fuels is that paraffins can have unacceptably low viscosities, which is another important property of distillate fuels.

Fischer Tropsch-derived distillate fuels also have known problems of poor lubricity, as explained in U.S. Pat. Nos. 5,689,031; 5,766,274; 6,017,372; 6,274,029; 6,296,757; 6,309,432; and 6,607,568. The solution proposed in these patents is typically to blend a hydrotreated Fischer Tropsch product with portions of the Fischer Tropsch product that have not been hydrotreated.

However, unless all components of the Fischer Tropsch-derived distillate are hydrotreated, the blend of Fischer Tropsch products can rapidly form peroxides as described in copending U.S. Patent Publication Nos. 20040152930 and 20040148850.

In contrast, distillate fuels produced from petroleum products often have high sulfur and aromatic levels, but have good or exceptional densities and volumetric energy contents. The high sulfur levels can be reduced by hydroprocessing, but hydroprocessing can result in reduction in aromatics to the extent that problems with seal swell, density, or volumetric energy content emerge. In addition, it has been found that hydrotreated petroleum stocks can have stability problems due to the formation of peroxides.

It may be desirable to produce blends of Fischer Tropsch-derived and petroleum-derived distillate fuels in an attempt to meet density and energy specifications. However, as described in U.S. Pat. No. 6,776,897, blends of Fischer Tropsch-derived and petroleum-derived distillate fuels can have poor stability in ASTM D6468 diesel test, which measures distillate fuel thermal stability, and as described in U.S. Patent Publication No. 20030116469 blends of Fischer Tropsch-derived and petroleum-derived distillate fuels can have poor stability in ASTM D3241, which measures thermal stability of jet fuels. An additional problem associated with highly paraffinic distillate fuels is that paraffins can have unacceptably low viscosities, which is another important property of distillate fuels.

An additional problem associated with hydroprocessing the highly paraffinic distillate fuels and/or the petroleum-derived distillate fuels is that hydroprocessing of these fuels consumes hydrogen. The hydrogen needed for these upgrading processes can be expensive to produce and to store, if necessary. Therefore, it would be desirable to minimize the need for this hydrogen.

Accordingly, there is a need in the art for distillate fuels with acceptable seal swell properties. There is further a need in the art for distillate fuels with satisfactory density properties. Finally, there is a need in the art for distillate fuels with satisfactory properties that can be obtained, at least in part, from Fischer-Tropsch process products. This invention provides such distillate fuels and the processes for their manufacture.

SUMMARY OF THE INVENTION

The present invention relates to a distillate fuel comprising a hydrocracked blend of about 10 to 90 weight % Fischer-Tropsch derived product and about 10 to 90 weight % petroleum derived product. The distillate fuel comprising greater than or equal to 5 weight % aromatics; greater than or equal to 1 weight % oxygenates; less than or equal to 10 ppm sulfur; and less than or equal to 10 ppm nitrogen. The distillate fuel has a stability of ≧65% as determined by ASTM D6468 when measured after 90 minutes at 150° C.; a net heat of combustion of ≧130,000 BTU/gallon as determined by ASTM D240; and a cetane index of ≧40.

In another embodiment, the present invention relates to a distillate fuel comprising a hydrocracked blend of a Fischer-Tropsch derived product and a petroleum derived product. The distillate fuel comprises greater than or equal to 2 weight % aromatics; greater than or equal to 0.1 weight % oxygenates; less than or equal to 10 ppm sulfur; and less than or equal to 10 ppm nitrogen. The distillate fuel has a stability of greater than or equal to 65% according to ASTM D6468 when measured after 90 minutes at 150° C. and a cetane index of greater than or equal to 40.

DETAILED DESCRIPTION OF THE INVENTION

According to the present invention, it has been discovered that a blend of a Fischer-Tropsch derived product and a petroleum derived product that is hydrocracked under certain conditions, provides a distillate fuel or distillate fuel blend stock with excellent properties, including good seal swell, density, and thermal stability. The blend comprising a Fischer-Tropsch derived product and a petroleum derived product is hydrocracked under conditions to preserve aromatics such that a product with a moderate amount of aromatics is provided. Preferably, the Fischer-Tropsch derived product is a Fischer Tropsch derived wax and the petroleum derived product is a petroleum vacuum gas oil.

Accordingly, the distillate fuel according to the present invention comprises a hydrocracked blend of a Fischer-Tropsch derived product and a petroleum derived product, wherein the distillate fuel comprises greater than or equal to 2 weight % aromatics, greater than or equal to 0.1 weight % oxygenates, less than or equal to 10 ppm sulfur, and less than or equal to 10 ppm nitrogen. The distillate fuels according to the present invention have good seal swell properties, thus preventing fuel leaks, and exhibit good thermal stability.

Accordingly, the present invention provides a distillate fuel or distillate fuel blend stock that has a combination of low sulfur, moderate aromatics, excellent stability in conventional tests, resistance to peroxide formation, improved seal swell, and acceptable density and volumetric energy content.

The distillate fuel according to the present invention may be suitable for use in a diesel engine, in a jet engine, or both. The distillate fuel according to the present invention may be used as directly as a distillate fuel. In the alternative, the distillate fuel according to the present invention may be used as blend stock and blended with other distillate fuel blend stocks to provide a distillate fuel suitable for use in a diesel engine or in a jet engine. The blend stock itself does not necessarily meet specifications for the respective fuel, but preferably the resulting combination of blend stocks does. Preferably, the distillate fuel blend stock according to the present invention is blended with a petroleum derived blend stock. When used as a distillate fuel blend stock, preferably the distillate fuel blend stock according to the present invention is blended with other blend stocks in an amount of greater than or equal to 10 weight percent and less than or equal to 90 weight percent.

For purposes of the present invention, the following definitions will be used herein:

The term "aromatics" means an unsaturated, cyclic and planar hydrocarbon group with an uninterrupted cloud of electrons containing an odd number of pairs of $\pi$ electrons. Any molecule that contains such a group is considered aromatic.

The term "paraffin" means a saturated straight or branched chain hydrocarbon (i.e., an alkane).

The term "olefins" means an unsaturated straight or branched chain hydrocarbon having at least one double bond (i.e., an alkene).

The term "oxygenates" means a hydrocarbon containing oxygen, i.e., an oxygenated hydrocarbon. Oxygenates include alcohols, ethers, carboxylic acids, esters, ketones, and aldehydes, and the like.

The terms "cycloparaffin", "cycloalkane", and "naphthene" are interchangeable and mean a hydrocarbon containing a saturated cyclic group, preferably of 3 to 8 ring atoms.

"Conventional petroleum products" comprise products derived from petroleum crude.

"Hydrocarbonaceous" means containing hydrogen and carbon atoms and potentially also containing heteroatoms, such as oxygen, sulfur, nitrogen, and the like.

"Hydrocarbonaceous asset" refers to natural gas, methane, coal, petroleum, tar sands, oils shale, shale oil, and derivatives and mixtures thereof.

The term "alkyl" means a linear saturated monovalent hydrocarbon radical of one to eight carbon atoms or a branched saturated monovalent hydrocarbon radical of three to eight carbon atoms. Examples of alkyl groups include, but are not limited to, groups such as methyl, ethyl, n-propyl, isopropyl, n-butyl, isobutyl, sec-butyl, t-butyl, n-pentyl, and the like.

The term "nitro" means the group —$NO_2$.

The term "hydroxy" means the group —OH.

The term "cycloalkyl" means a cyclic saturated hydrocarbon group of 3 to 8 ring atoms, where one or two of C atoms are optionally replaced by a carbonyl group. The cycloalkyl group may be optionally substituted with one, two, or three substituents, preferably alkyl, alkenyl, halo, hydroxyl, cyano, nitro, alkoxy, haloalkyl, alkenyl, and alkenoxy. Representative examples include, but are not limited to, cyclopropyl, cyclohexyl, cyclopentyl, and the like.

The term "aryl" means a monovalent monocyclic or bicyclic aromatic carbocyclic group of 6 to 14 ring atoms. Examples include, but are not limited to, phenyl, naphthyl, and anthryl. The aromatic ring may be optionally fused to a 5-, 6-, or 7-membered monocyclic non-aromatic ring optionally containing 1 or 2 heteroatoms independently selected from oxygen, nitrogen, or sulfur, the remaining ring atoms being C where one or two C atoms are optionally replaced by a carbonyl. Representative aryl groups with fused rings include, but are not limited to, 2,5-dihydro -benzo[b]oxepine, 2,3-dihydrobenzo[1,4]dioxane, chroman, isochroman, 2,3-dihydrobenzofuran, 1,3-dihydroisobenzofuran, benzo[1,3]dioxole, 1,2,3,4-tetrahydroisoquinoline, 1,2,3,4-tetrahydroquinoline, 2,3-dihydro-1Hindole, 2,3-dihydro1H-isoindle, benzimidazole-2-one, 2-H-benzoxazol-2-one, and the like.

The term "phenyl" means a six membered aromatic group (i.e., $C_6H_5$—).

The term "phenol" means a six membered aromatic compound in which one or more hydroxy groups are attached directly to the ring.

The term "alkylphenol" means a phenolic compound in which one or more of the remaining hydrogen atoms attached directly to the ring are replaced by alkyl groups. Preferably, the alkylphenol has one hydroxy group and one alkyl group directly attached to the ring and is a compound of the formula $C_6H_4(OH)(R)$ wherein R is an alkyl group.

The term "cyclic amine" means refers to an amino compound in which one of the groups attached to the —N— of the amine is a cycloalkyl or an aryl.

The term "sulfur-free antioxidant" means an antioxidant that contains sulfur only at the impurity level. Accordingly, the sulfur-free antioxidants of the present invention contain essentially no sulfur. A sulfur-free antioxidant contains less than 100 ppm sulfur, preferably less than 10 ppm sulfur, and even more preferably no undetectable level of sulfur. A sulfur-free antioxidant has a sulfur content low enough that when the antioxidant is added to a fuel, the fuel plus antioxidant has a sulfur content of less than 1 ppm. For example, assuming the fuel itself contains no sulfur, and that 100 ppm of the antioxidant are added to the fuel, the sulfur-free antioxidant contains less than 1 weight % sulfur.

The term "effective amount of a sulfur-free antioxidant" means the amount added to a distillate fuel according to the present invention to provide a distillate fuel having a peroxide content of less than 5 ppm after storage at 60° C. for four weeks. The distillate fuel according to the present invention containing an effective amount of sulfur free antioxidant preferably also has a reflectance as measured by ASTM D6468 of greater than 65% when measured at 150° C. for 90 minutes.

The term "derived from a petroleum" or "petroleum derived" means that the product, fraction, or feed originates from petroleum crude by distillate or other separation methods. A source of the petroleum derived can be from a gas field condensate. Petroleum derived products include, but are not limited to, straight run distillates, cracked stocks such as cycle oils and coker gas oils, and hydrotreated or hydrocracked stocks.

The term "derived from a Fischer-Tropsch process" or "Fischer-Tropsch derived," means that the product, fraction, or feed originates from or is produced at some stage by a Fischer-Tropsch process.

A distillate fuel is a material containing hydrocarbons with boiling points between approximately 60° F. to 1100° F. The term "distillate" means that typical fuels of this type can be generated from vapor overhead streams from distilling petroleum crude. In contrast, residual fuels cannot be generated from vapor overhead streams by distilling petroleum crude, and are the non-vaporizable remaining portion. While not typical distillate fuels, distillate fuels may also include fuels derived from Fischer-Tropsch processes. Within the broad category of distillate fuels are specific fuels that include: naphtha, jet fuel, diesel fuel, kerosene, aviation gas, fuel oil, and blends thereof.

A "distillate fuel blend stock" is a material that is mixed with other distillate fuel blend stocks to provide a distillate fuel, in particular a diesel or jet fuel, as herein defined. The blend stock itself does not necessarily meet specifications for the respective fuel, but preferably the resulting combination of blend stocks does. Jet fuel blend stocks are combined with other jet fuel blend stocks, and optionally additives, to provide jet fuel. Similarly, diesel fuel blend stocks are combined with other diesel fuel blend stocks, and optionally additives, to provide diesel fuel.

A "diesel fuel" is a material suitable for use in diesel engines, typically a hydrocarbon material with boiling points between $C_5$ and 800° F., preferably between 280 and 750° F. $C_5$ analysis is performed by gas chromatography, and the temperatures refer to the 95% boiling points as measured by ASTM D-2887. A diesel fuel may be comprised of a combination of blend stocks or a single blend stock in the absence of other blend stocks with only the optional addition of minor amounts of additives. Preferably, a diesel fuel conforms to at least one of the following specifications:

ASTM D975—"Standard Specification for Diesel Fuel Oils"

European Grade CEN 90

Japanese Fuel Standards JIS K 2204

The United States National Conference on Weights and Measures (NCWM) 1997 guidelines for premium diesel fuel The United States Engine Manufacturers Association recommended guidelines for premium diesel fuel (FQP-1A)

A "jet fuel" is a material suitable for use in turbine engines in aircraft or other uses. A jet fuel may be comprised of a combination of blend stocks or a single blend stock in the absence of other blend stocks with only the optional addition of minor amounts of additives. Preferably, a jet fuel conforms to at least one of the following specifications:

ASTM D1655

DEF STAN 91-91/3 (DERD 2494), TURBINE FUEL, AVIATION, KEROSENE TYPE, JET A-1, NATO CODE: F-35

International Air Transportation Association (IATA) Guidance Materials for Aviation, $4^{th}$ edition, March 2000

The "Cetane Index" was determined by ASTM D4737-96a (2001) Standard Test Method for Calculated Cetane Index by Four Variable Equation. Preferably, the distillate fuels according to the present invention have a cetane index of ≧40.

A "remote site" is a location away from a refinery or market that may have a higher cost of construction than the cost of construction at the refinery or market. In quantitative terms, the distance of transportation between the remote site and the refinery or market is at least 100 miles, preferably more than 500 miles, and most preferably more than 1,000 miles.

It has been surprisingly discovered that when a blend of a Fischer Tropsch derived product and a petroleum derived product is hydrocracked under appropriate conditions to preserve aromatics a distillate fuel is provided that exhibits exceptionally good seal swell properties and density properties and exceptionally good thermal stability. Accordingly, the distillate fuel according to the present invention comprises a hydrocracked blend of a Fischer-Tropsch derived product and a petroleum derived product, preferably a hydrocracked blend of a Fischer Tropsch wax and a petroleum vacuum gas oil.

The distillate fuels according to the present invention comprise a hydrocracked blend of about 1 to 99 weight % Fischer-Tropsch derived product and about 99 to 1 weight % petroleum derived product. Preferably, the distillate fuels according to the present invention comprise a hydrocracked blend of about 10 to 90 weight % Fischer-Tropsch derived product and about 90 to 10 weight % petroleum derived product. More preferably, the distillate fuels according to the present invention comprise a hydrocracked blend of about 25 to 75 weight % Fischer-Tropsch derived product and about 75 to 25 weight % petroleum derived product. Even more preferably, the distillate fuels according to the present invention comprise a hydrocracked blend of about 30 to 50 weight % Fischer-Tropsch derived product and about 70 to 50 weight % petroleum derived product.

The Fischer-Tropsch derived product of the distillate fuel comprises greater than or equal to 50 weight percent, preferably greater than or equal to 75 weight percent, more preferably greater than or equal to 90 weight percent, and even more preferably greater than or equal to 95 weight percent, of Fischer-Tropsch derived products boiling above 650° F. The petroleum derived product of the distillate fuel comprises greater than or equal to 50 weight percent, preferably greater than or equal to 75 weight percent, more preferably greater than or equal to 90 weight percent, and most preferably greater than or equal to 95 weight percent, of petroleum derived products boiling above 650° F. The content of nitrogen in the petroleum derived product is greater than or equal to 500 ppm, preferably greater than or equal to 1,000 ppm, more preferably greater than or equal to 2,000 ppm, and most preferably greater than or equal to 2,400 ppm.

The fuels of the present invention may be described as highly paraffinic, moderately aromatic distillate fuels. A highly paraffinic, moderately aromatic distillate fuel is a distillate fuel that contains more than 70 weight % paraffins, preferably more than 80 weight % paraffins, and most preferably more than 90 weight % paraffins and greater than or equal to 2 weight % aromatics, preferably greater than or equal to 5 weight % aromatics, more preferably greater than or equal to 10 weight % aromatics, and even more preferably greater than or equal to 25 weight % aromatics. This aromatics content improves seal swell properties according to ASTM D1414 ("Standard Test Methods for Rubber O-Rings").

The distillate fuels of the present invention exhibit good seal swell volume increases as measured by ASTM D 471. ASTM D471 covers the required procedures to evaluate the comparative ability of rubber and rubber-like compositions to withstand the effect of liquids. It is designed for testing specimens of vulcanized rubber cut from standard sheets, specimens cut from fabric coated with vulcanized rubber, or finished articles of commerce. ASTM D471 provides procedures for exposing test specimens to the influence of liquids under definite conditions of temperature and time. The resulting deterioration is determined by measuring the changes in mass, volume, and dimension, before and after immersion in the test liquid. The test is particularly used for certain rubber articles, such as seals, gaskets, hoses, diaphragms, and sleeves which may be exposed to oils, greases, fuels, and other fluids during service. One of skill in the art could readily evaluate a distillate fuel using ASTM D471 to determine the volume change of a seal or gasket. It is to be understood that while stated that the fuels of the present invention exhibit a volume change as measured by ASTM D47 1, it is actually the rubber or rubber-like composition being tested that exhibits the volume change and not the fuels themselves.

A Buna N O-ring is a seal made from nitrile elastomer and is suitable for use in ASTM D471. Other suitable nitrile O-rings for use in ASTM D471 can be obtained from a number of sources, such as American United (compound C-70) and Parker Seals. Parker Seals provides three types of O-rings: standard nitrile, type N674; fuel-resistant nitrile (high-acrylic acrylonitrile), type N497; and fluorocarbon, type V747. Of these, the standard nitrile O-ring is the only one suitable for ASTM D471 as it is similar to the O-rings in common use in current diesel engines. The fuel-resistant and fluorocarbon O-rings are not representative of gaskets in wide commercial use.

The distillate fuels according to the present invention exhibit a seal swell volume increase as measured by ASTM D 471 at 23+/−2° C. and for 70 hours when using a nitrile O-ring seal of ≧0.2%, preferably ≧0.5%, and more preferably ≧1.0%.

The aromatics of the present invention are predominantly mono-aromatics (alkylbenzenes), with minimal amounts of polynuclear aromatics. Preferably, the aromatics comprise less than 25 weight % polynuclear aromatics, more preferably less than 10 weight % polynuclear aromatics, and most preferably less than 5 weight % polynuclear aromatics.

The paraffin content of the fuels of the present invention is at least 70 weight %, preferably at least 80 weight %, and most preferably at least 90 weight %. The paraffins will consist of a mixture of normal and iso-paraffins with the ratio of iso/normal paraffins in the fuel being between 0.3 and 10. Higher proportions of iso-paraffins are preferred when the fuel is intended for use in cold climates (Jet Al or diesel for arctic use).

In addition, the fuels of the present invention contain moderate amounts of oxygenates. Preferably, the distillate fuels of the present invention comprise ≧0.1 weight % oxygenates, more preferably ≧0.5 weight % oxygenates, even more preferably ≧1.0 weight % oxygenates, and even more preferably ≧2.5 weight % oxygenates.

Furthermore, the fuels of the present invention preferably contain low levels of olefins. The fuels of the present invention preferably contain <5.0 weight % olefins, more preferably <2.0 weight % olefins, and even more preferably <1.0 weight % olefins.

A modified version of ASTM D6550 (Standard Test Method for the Determination of the Olefin Content of Gasolines by Supercritical Fluid Chromatography—SFC) was used to determine the group types in the feedstocks and products. The modified method is to quantify the total amount of saturates, aromatics, oxygenates and olefins by making a 3-point calibration standard. Calibration standard solutions were prepared using the following compounds: undecane, toluene, n-octanol and dodecene. External standard method was used for quantification and the detection limit for aromatics and oxygenates is 0.1% wt and for olefins is 1.0% wt. Please refer to ASTM D6550 for instrument conditions.

A small aliquot of distillate fuel sample was injected onto a set of two chromatographic columns connected in series and transported using supercritical carbon dioxide as the mobile phase. The first column was packed with high surface area silica particles. The second column contained high surface area silica particles loaded with silver ions.

Two switching valves were used to direct the different classes of components through the chromatographic system to the detector. In a forward-flow mode, saturates (normal and branched alkanes and cyclic alkanes) pass through both columns to the detector, while the olefins are trapped on the silver-loaded column and the aromatics and oxygenates are retained on the silica column. Aromatic compounds and oxygenates were subsequently eluted from the silica column to the detector in a back flush mode. Finally, the olefins were back flushed from the silver-loaded column to the detector.

A flame ionization detector (FID) was used for quantification. Calibration was based on the area of the chromatographic signal of saturates, aromatics, oxygenates and olefins, relative to standard reference materials, which contain a known mass % of total saturates, aromatics, oxygenates and olefins as corrected for density. The total of all analyses was within 3% of 100% and normalized to 100% for convenience.

The weight % olefins can also be calculated from the bromine number and the average molecular weight by use of the following formula:

$$\text{Wt \% Olefins} = (\text{Bromine No.})(\text{Average Molecular Weight})/159.8.$$

It is preferable to measure the average molecular weight directly by appropriate methods, but it can also be estimated by correlations using the API gravity and mid-boiling point as described in "Prediction of Molecular Weight of Petroleum Fractions" A. G. Goossens, IEC Res. 1996, 35, p.985-988.

Preferably the olefins and other components are measured by the modified SFC method as described above.

A GCMS analysis of the Fischer Tropsch feedstocks determined that the saturates were almost exclusively n-paraffins, and the oxygenates were predominantly primary alcohols, and the olefins were predominantly primary linear olefins (alpha olefins).

The distillate fuels according to the present invention have low sulfur and nitrogen content. Preferably, sulfur is present in amounts less than 10 ppm, more preferably less than 5 ppm, and even more preferably less than 1 ppm. According to the present invention, sulfur analyses were performed according to ASTM D 4294, except for samples of less than 10 ng/μL in which sulfur was measured as determined by ultraviolet fluorescence by ASTM D 5453-00 using an Antek 9000. Preferably, nitrogen is present in amounts less than 10 ppm, more preferably less than 5 ppm, and even more preferably less than 1 ppm. Nitrogen analyses were performed according to ASTM D 5762. As the fuels of the present invention typically have both low sulfur (<10 ppm, preferably <1 ppm) and low nitrogen content (<10 ppm, preferably <1 ppm), environmental emissions of oxides of these heteroatoms are minimized. Accordingly, the fuels of the present invention are desirable as environmentally friendly.

The fuels of the present invention may conform to at least one specification for either diesel or jet fuel. When used as a diesel fuel, the distillate fuels of the present invention preferably conform to ASTM D975 diesel fuel specifications. When used as a jet fuel, the distillate fuels of the present invention preferably conform to ASTM D1655 jet fuel specifications.

In the alternative, the fuels of the present invention may be used as distillate fuel blend stocks and blended with other distillate fuel blend stocks to provide a distillate fuel conforming to at least one specification for either diesel or jet fuel.

The distillate fuels according to the present invention exhibit at least acceptable, and most often excellent, stabilities. ASTM specifications for Diesel Fuel (D985) describe stability measurements for the respective fuels. For diesel fuel, ASTM D6468, "Standard Test Method for High Temperature Stability of Distillate Fuels" is under consideration as a standard test method for a diesel fuel and this test can provide a good measure of the stability of the fuel. The distillate fuels according to the present invention typically have excellent stabilities in this test.

ASTM D6468 describes the test to measure distillate fuel thermal stability. As part of the present invention, it has been discovered that a minimum acceptable fuel has a reflectance value of 65 percent according to ASTM D6468 where the test is conducted at 150° C. for 90 minutes. Even more preferred is a reflectance value of 80 percent or greater. Premium fuel would preferably have a reflectance value of 80 percent at 150° C. for 180 minutes. Fuels having even higher stability according to reflectance value are desirable. Thus, a preferred fuel will have a reflectance value of 90 percent or greater when the test is conducted at 150° C. for 180 minutes. While ASTM D6468 is the preferred test for stability of diesel fuels according to the present invention, one skilled in the art will recognize that it may be possible to develop alternative tests which correlate directly with the results of ASTM D6468 when conducted according to the present invention. Therefore, the process of the invention should not be limited to only the use of ASTM D6468 in step, but also should include equivalent tests which produce the same or very similar results.

The distillate fuels according to the present invention suitable for use as diesel fuels have a percent reflectance as measured by ASTM D6468 at 150° C. in excess of 65% when measured at 90 minutes, preferably in excess of 80% when measured at 90 minutes, more preferably in excess of 65% when measured at 180 minutes, even more preferably in excess of 80% when measured at 180 minutes, and even more preferably in excess of 90% when measured at 180 minutes.

The distillate fuels according to the present invention suitable for use as jet fuels, on the other hand, will have a passing rating in ASTM D3241 (JFTOT Procedure) at 260° C. for 2.5 hours. A passing rating corresponds to a tube rating of less than 3 (Code 3) and a pressure drop across a filter of less than 25 mm Hg.

In addition to conventional measurements of stability (thermal and storage), studies by Vardi et al (J. Vardi and B. J. Kraus, "Peroxide Formation in Low Sulfur Automotive Diesel Fuels," February 1992, SAE Paper 920826) describe how fuels can develop significant levels of peroxide during storage, and how these peroxides can attack fuel system elastomers (O-rings, hoses, etc.). The formation of peroxides can be measured by Infrared spectroscopy, chemical methods, or by the attack on elastomer samples. As described by Vardi et al, fuels can become unstable with respect to peroxide formation when their sulfur content is reduced to low levels by hydroprocessing. Vardi et al also describe how compounds like tetralin can cause fuels to become unstable with respect to peroxide formation, while polycyclic aromatic compounds like naphthalenes can improve stability. Vardi et al. explains that aromatics act as natural antioxidants and notes that natural peroxide inhibitors such as sulfur compounds and polycyclic aromatics can be removed.

The distillate fuels according to the present invention also exhibit excellent stabilities, as measured by resistance to peroxide formation. Specifically, the distillate fuels according to the present invention comprise ≦5 ppm peroxides. The distillate fuels according to the present invention also have a increase in peroxide content of less than about 5 ppm after 4 weeks, preferably less than about 4 ppm after 4 weeks, and most preferably less than about 1 ppm after 4 weeks. The peroxide content is determined by ASTM D3703 at 60° C.

Typical low sulfur diesel fuels have relative densities between 0.83 and 0.86 g/cm$^3$ at 15° C. The range of acceptable densities at 15° C. for jet fuel is 0.775 to 0.840 g/cm$^3$, according to ASTM D1655. Accordingly, the distillate fuels according to the present invention when used as diesel fuels have a relative density of between 0.83 and 0.86 g/cm$^3$ at 15° C. Accordingly, the distillate fuels according to the present invention when used as jet fuels have densities of at least 0.775 g/cm$^3$ at 15° C. to about 0.840 g/cm$^3$. Therefore, preferably the distillate fuels according to the present invention have a relative density of between about 0.775 and 0.86 g/cm$^3$ at 15° C. These densities will provide acceptable ranges of use for the fuels.

Due to their high content of paraffins, the highly paraffinic, moderately aromatic distillate fuels of the present invention have excellent combustion properties. Characteristic combustion properties of the fuels of the present invention include smoke points in excess of 25 mm, preferably in excess of 30 mm, and cetane numbers in excess of 40, preferably in excess of 50, and more preferably in excess of 60. In addition, preferably, the distillate fuels of the present invention have a net heat of combustion as measured by ASTM D-240, of ≧130,000 BTU/gal, more preferably ≧130,500 BTU/gal, and even more preferably ≧130,750 BTU/gal.

Kinematic viscosity is a measurement of the resistance to flow of a fluid under gravity. Often the correct operation of equipment depends upon the appropriate viscosity of the fluid being used. Kinematic viscosity is determined by ASTM D 445-01. The results are reported in centistokes (cSt). Typically paraffins have unacceptably low viscosities for distillate fuels. As noted for No. 1-D and No. 2D diesel fuels in "Technical Review, Diesel Fuels, Chevron Products Company" page 34, distillate fuels should have a viscosity at 40° C. of at least 1.3 cSt, preferably at least 1.9 cSt, more preferably at least 1.9 cSt but not more than 4.5 cSt, and most preferably at least 1.9 cSt but not more than 4.1 cSt. The upper limit of 4.5 cSt is based on the European CEN 590 specification described in this reference.

The distillate fuels of the present invention have a kinematic viscosity of ≧1.3 cSt at 40° C. and preferably ≧1.9 cSt at 40° C. More preferably, the distillate fuels of the present invention have a kinematic viscosity of between about 1.9 cSt and 4.5 cSt at 40° C. and even more preferably, the distillate fuels of the present invention have a kinematic viscosity of between about 1.9 cSt and 4.1 cSt at 40° C.

The distillate fuels according to the present invention comprise a hydrocracked blend of a Fischer Tropsch derived product and a petroleum derived product.

Fischer-Tropsch Derived Product

The Fischer Tropsch derived product originates from or is produced at some stage by a Fischer-Tropsch process.

In Fischer-Tropsch chemistry, syngas is converted to liquid hydrocarbons by contact with a Fischer-Tropsch catalyst under reactive conditions. Typically, methane and optionally heavier hydrocarbons (ethane and heavier) can be sent through a conventional syngas generator to provide synthesis gas. Generally, synthesis gas contains hydrogen and carbon monoxide, and may include minor amounts of carbon dioxide and/or water. The presence of sulfur, nitrogen, halogen, selenium, phosphorus and arsenic contaminants in the syngas is undesirable. For this reason and depending on the quality of the syngas, it is preferred to remove sulfur and other contaminants from the feed before performing the Fischer-Tropsch chemistry. Means for removing these contaminants are well known to those of skill in the art. For example, ZnO guardbeds are preferred for removing sulfur impurities. Means for removing other contaminants are well known to those of skill in the art. It also may be desirable to purify the syngas prior to the Fischer-Tropsch reactor to remove carbon dioxide produced during the syngas reaction and any additional sulfur compounds not already removed. This can be accomplished, for example, by contacting the syngas with a mildly alkaline solution (e.g., aqueous potassium carbonate) in a packed column.

In the Fischer-Tropsch process, liquid and gaseous hydrocarbons are formed by contacting a synthesis gas comprising a mixture of $H_2$ and CO with a Fischer-Tropsch catalyst under suitable temperature and pressure reactive conditions. The Fischer-Tropsch reaction is typically conducted at temperatures of about 300 to 700° F. (149 to 371° C.), preferably about from 400 to 550° F. (204 to 228° C.); pressures of about from 10 to 600 psia, (0.7 to 41 bars), preferably 30 to 300 psia, (2 to 21 bars) and catalyst space velocities of from about 100 to about 10,000 cc/g/hr, preferably 300 to 3,000 cc/g/hr.

Examples of conditions for performing Fischer-Tropsch type reactions are well known to those of skill in the art. Suitable conditions are described, for example, in U.S. Pat. Nos. 4,704,487, 4,507,517, 4,599,474, 4,704,493, 4,709,108, 4,734,537, 4,814,533, 4,814,534 and 4,814,538, the contents of each of which are hereby incorporated by reference in their entirety.

The products of the Fischer-Tropsch synthesis process may range from $C_1$ to $C_{200+}$ with a majority in the $C_5$ to $C_{100+}$ range. The reaction can be conducted in a variety of reactor types; for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP0609079.

In general, Fischer-Tropsch catalysts contain a Group VIII transition metal on a metal oxide support. The catalysts may also contain a noble metal promoter(s) and/or crystalline molecular sieves. Suitable Fischer-Tropsch catalysts comprise one or more of Fe, Ni, Co, Ru and Re, with cobalt being preferred. A preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

Certain catalysts are known to provide chain growth probabilities that are relatively low to moderate, and the reaction products include a relatively high proportion of low molecular ($C_{2-8}$) weight olefins and a relatively low proportion of high molecular weight ($C_{30+}$) waxes. Certain other catalysts are known to provide relatively high chain growth probabilities, and the reaction products include a relatively low proportion of low molecular ($C_{2-8}$) weight olefins and a relatively high proportion of high molecular weight ($C_{30+}$) waxes. Such catalysts are well known to those of skill in the art and can be readily obtained and/or prepared.

The product from a Fischer-Tropsch process contains predominantly paraffins. The products from Fischer-Tropsch reactions generally include a light reaction product and a waxy reaction product. The light reaction product (i.e., the condensate fraction) includes hydrocarbons boiling below about 700° F. (e.g., tail gases through middle distillate fuels), largely in the $C_5$-$C_{20}$ range, with decreasing amounts up to about $C_{30}$. The waxy reaction product (i.e., the wax fraction) includes hydrocarbons boiling above about 600° F. (e.g., vacuum gas oil through heavy paraffins), largely in the $C_{20+}$ range, with decreasing amounts down to $C_{10}$.

Both the light reaction product and the waxy product are substantially paraffinic. The waxy product generally comprises greater than 70 weight % normal paraffins, and often greater than 80 weight % normal paraffins. The light reaction product comprises paraffinic products with a significant proportion of alcohols and olefins. In some cases, the light reaction product may comprise as much as 50 weight %, and even higher, alcohols and olefins. It is the waxy reaction product (i.e., the wax fraction) that is used in the distillate fuels according to the present invention.

Petroleum-Derived Product

The petroleum derived product originates from petroleum crude by distillate or other separation methods. A source of the petroleum derived can be from a gas field condensate. Petroleum derived products include, but are not limited to, straight run distillates, cracked stocks such as cycle oils and coker gas oils, and hydrotreated or hydrocracked stocks. Preferably, the petroleum derived product is a vacuum gas oil. Since the petroleum derived product is used in a hydrocracked blend also comprising a Fischer-Tropsch derived product, the nitrogen and sulfur contents of the initial petroleum derived product can be relatively high.

Blends

The blends to provide the distillate fuels of the present invention comprise a Fischer-Tropsch derived product and a petroleum derived product. The blends comprise from about 1 to 99 weight % Fischer-Tropsch derived product and about 99 to 1 weight % petroleum derived product. Preferably, the blends according to the present invention comprise about 10 to 90 weight % Fischer-Tropsch derived product and about 90 to 10 weight % petroleum derived product. More preferably, the blends according to the present invention comprise about 25 to 75 weight % Fischer-Tropsch derived product and about 75 to 25 weight % petroleum derived product. Even more preferably, the blends according to the present invention comprise about 30 to 50 weight % Fischer-Tropsch derived product and about 70 to 50 weight % petroleum derived product.

The Fischer-Tropsch derived product of the blend comprises greater than or equal to 50 weight percent, preferably greater than or equal to 75 weight percent, more preferably greater than or equal to 90 weight percent, and even more preferably greater than or equal to 95 weight percent, of Fischer-Tropsch derived products boiling above 650° F.

The petroleum derived product of the blend comprises greater than or equal to 50 weight percent, preferably greater than or equal to 75 weight percent, more preferably greater than or equal to 90 weight percent, and most preferably greater than or equal to 95 weight percent, of petroleum derived products boiling above 650° F. Since the petroleum derived product is used in a hydrocracked blend also comprising a Fischer-Tropsch derived product, the nitrogen and sulfur contents of the initial petroleum derived product can be relatively high. As such, the content of nitrogen of the petroleum derived product can be greater than or equal to 500 ppm, greater than or equal to 1,000 ppm, greater than or equal to 2,000 ppm, and even greater than or equal to 2,400 ppm.

The blend may be made by blending the Fischer-Tropsch derived product and the petroleum derived product by techniques known to those of skill in the art.

The blend according to the present invention comprising a Fischer-Tropsch derived product and a petroleum derived product is hydrocracked.

Hydrocracking

The distillate fuel according to the present invention comprises a hydrocracked blend of a Fischer-Tropsch derived product and a petroleum derived product. Generally, hydrocracking is utilized to reduce the size of the hydrocarbon molecules, hydrogenate olefin bonds, hydrogenate aromatics and remove traces of heteroatoms. However, the blend of a Fischer-Tropsch derived product and petroleum derived product is hydrocracked under conditions such that a distillate fuel with exceptionally good seal swell properties and density properties, as described herein, is provided. The resulting distillate fuel is highly paraffinic and moderately aromatic as defined herein. Therefore, the hydrocracking process used in the present invention provides a product comprising a moderate amount of aromatics.

Preferably, the hydrocracking process according to the present invention is conducted to provide a distillate fuel product comprising greater than or equal to 2 weight percent aromatics, greater than or equal to 0.1 weight percent oxygenates, less than or equal to 10 ppm sulfur, and less than or equal to 10 ppm nitrogen.

Hydrocracking according to the present invention may be conducted according to conventional methods known to those of skill in the art, but with controlling the conditions for hydrocracking such that a distillate fuel product comprising a moderate amount of aromatics and the above-described properties is provided. The hydrocracking process is effected by contacting the particular fraction or combination of fractions, with hydrogen in the presence of a suitable hydrocracking catalyst at a suitable temperature. The hydrocracking process according to the present invention is conducted at temperatures in the range of from about 600 to 900° F. (316 to 482° C.), preferably at a temperature of greater than 650° F. (343 to 454° C.), more preferably at a temperature of greater than 700° F., even more preferably at a temperature of greater than 725° F. Even more preferably, the hydrocracking process according to the present invention is conducted at a temperature of about 725 to 800° F. The hydrocracking process according to the present invention is conducted at a pressure of less than or equal to 3,000 psia, preferably less than or equal to 2,500 psia, even more preferably less than or equal to 1,500 psia, and even more preferably less than or equal to 1,000 psia. The hydrocracking process according to the present invention is conducted using space velocities based on the hydrocarbon feedstock of about 0.1 to 2.0 $hr^{-1}$, preferably 0.2 to 1.0 $hr^{-1}$, more preferably 0.5 to 0.75 $hr^{-}$. The hydrocracking process according to the present invention is conducted with hydrogen being added at a rate of 1 to 20 MSCF/B (thousand standard cubic feet per barrel), preferably 2 to 10 MSCF/B, and more preferably 5 to 7.5 MSCF/B.

Preferred hydroprocessing conditions according to the present invention are summarized in the following Table II.

TABLE II

| Property | Broad | Preferred | More Preferred | Most Preferred |
|---|---|---|---|---|
| Temperature, ° F. | ≧600 | ≧700 | ≧725 | 725-800 |
| Pressure, psig | ≦3,000 | ≦2,500 | ≦1,500 | ≦1,000 |
| LHSV, $hr^{-1}$ | 0.1-2.0 | 0.2-1.0 | 0.5-0.75 | |
| $H_2$ addition, MSCF/Bbl | 1-20 | 2-10 | 5-7.5 | |

Suitable catalysts for hydrocracking operations are known in the art and include sulfided catalysts. Sulfided catalyst may comprise amorphous silica-alumina, alumina, tungsten, nickel, cobalt, and molybdenum.

Nitrogen can be a hydrocracking catalyst poison. Accordingly, too much nitrogen in the feed to the hydrocracking unit can poison the hydrocracking catalyst, which can be a problem when hydrocracking petroleum derived products. The petroleum derived product may comprise a content of nitrogen that would poison the hydrocracking catalyst if hydrocracked alone; however, when blended with the Fischer Tropsch derived product, the nitrogen content of the blend will be low enough not to poison the hydrocracking catalyst. In the alternative, the petroleum derived product may be hydrotreated prior to blending to reduce the nitrogen content if necessary, or the blend may be hydrotreated prior to hydrocracking to reduce the nitrogen content if necessary.

Hydrotreating

Optionally, the blend of the Fischer-Tropsch derived product and the petroleum derived product may be hydrotreated prior to hydrocracking. In the alternative, either one or both of the Fischer-Tropsch derived product and the petroleum derived product individually may be hydrotreated prior to hydrocracking to remove heteroatoms such as sulfur, nitrogen, ammonia, and water. The heteroatoms removed by hydrotreating are preferably stripped from the product prior to hydrocracking. Preferably, the petroleum derived product is hydrotreated prior to blending with the Fischer-Tropsch derived product.

Hydrotreating refers to a catalytic process, usually carried out in the presence of free hydrogen, in which the primary purpose is the removal of various metal contaminants, such as arsenic, aluminum, and cobalt; heteroatoms, such as sulfur and nitrogen; oxygenates; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated.

Catalysts used in carrying out hydrotreating operations are well known in the art. See, for example, U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and Group VIII and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, but are usually employed in their reduced or sulfided forms when such sulfide compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

Typical hydrotreating conditions vary over a wide range. In general, the overall LHSV is about 0.25 to 2.0, preferably about 0.5 to 1.5. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures in the reactor will range from about 300° F. to about 750° F. (about 150° C. to about 400° C.), preferably ranging from 450° F. to 725° F. (230° C. to 385° C.).

Removal of Polynuclear Aromatics

To meet the desired low content of polynuclear aromatics in the distillate fuels of the present invention, the product stream from the hydrocracking operation can be further treated to remove polynuclear aromatics. Options for selectively removing polynuclear aromatics from the product stream while leaving desired mono-aromatics, include selective hydrotreating and adsorption.

The most preferred operation for removing polynuclear aromatics from the product stream is selective hydrotreating. The reaction conditions for selective hydrotreating do not vary greatly from the reaction conditions for hydrotreating described above. Reaction conditions for selective hydrotreating include low temperatures (less than 750° F., preferably less than 700° F., most preferably less than 600° F.), high pressures (greater than 250 psig, preferably greater than 350 psig, most preferably greater than 500 psig), and short contact times (LHSV of less than 5 $hr^{-1}$, preferably less than 3 $hr^{-1}$, and most preferably less than 2 $hr^{-1}$). Preferred catalysts for this selective hydrotreating contain Pt, Pd, and combinations thereof. The selective hydrotreating will reduce the polynuclear aromatic content by at least 50 weight %, preferably at least 75 weight %, and most preferably at least 90 weight %, and the mono-aromatic content by less than 50 weight %, preferably less than 35 weight %, and most preferably less than 20 weight %.

The removal of polynuclear aromatics from the product stream can also be achieved by adsorption on an oxide support, preferably one that has moderate acidity (an acidic clay such as montmorillonite or attapulgite). The temperatures for adsorption should be less than 200° F., preferably less than 150° F. Polynuclear aromatics can also be extracted with a solvent, such as n-methyl pyrollidinone or furfural.

Distillate Fuel or Distillate Fuel Blend Stock

The distillate fuel or distillate fuel blend stock according to the present invention comprises a hydrocracked blend of a Fischer-Tropsch derived product and a petroleum derived product.

The distillate fuels or distillate fuel blend stocks according to the present invention have a combination of low sulfur, moderate aromatics, excellent stability in conventional tests, resistance to peroxide formation, improved seal swell, and acceptable density and volumetric energy content. The distillate fuel according to the present invention may be suitable for use in a diesel engine, in a jet engine, or both. The distillate fuel according to the present invention may be used as directly as a distillate fuel. In the alternative, the distillate fuel according to the present invention may be used as blend stock and blended with other distillate fuel blend stocks to provide a distillate fuel suitable for use in a diesel engine or in a jet engine.

The distillate fuels of the present invention may be described as highly paraffinic, moderately aromatic distillate fuels. A highly paraffinic, moderately aromatic distillate fuel is a distillate fuel that contains more than 70 weight % paraffins, preferably more than 80 weight % paraffins, and most preferably more than 90 weight % paraffins and greater than or equal to 2 weight % aromatics, preferably greater than or equal to 5 weight % aromatics, more preferably greater than or equal to 10 weight % aromatics, and even more preferably greater than or equal to 25 weight % aromatics. This aromatics content improves seal swell properties according to ASTM D1414 ("Standard Test Methods for Rubber O-Rings").

Preferred properties of the distillate fuels according to the present invention are summarized in summarized in the following Table III.

TABLE III

| Property | Broad | Preferred | More Preferred | Even More Preferred |
|---|---|---|---|---|
| Sulfur, ppm | ≦10 | ≦1 | | |
| Nitrogen, ppm | ≦10 | ≦1 | | |
| Net Heat of combustion according to ASTM D240, BTU/Gal | ≧130,000 | ≧130,500 | ≧130,750 | |
| Stability according to ASTM D6468 at 150° C. | ≧65% for 90 minutes | ≧80% for 90 minutes | ≧80% for 180 minutes | ≧90% for 180 minutes |
| Cetane index according to ASTM D976 | ≧40 | | | |
| % volume increase according to ASTM D471 at 23 +/− 2° C. and for 70 hours when using a nitrile O-ring seal | ≧0.2 | ≧0.5 | ≧1.0 | |
| Viscosity according to ASTM D445 at 40° C., cSt | ≧1.3 | ≧1.9 | 1.9-4.5 | 1.9-4.1 |
| Aromatics by SFC, wt % | ≧2 | ≧5 | ≧10 | ≧25 |
| Oxygenates by SFC, wt % | ≧0.1 | ≧0.5 | ≧1.0 | ≧2.5 |
| Peroxide Content, ppm | ≦5 | | | |
| Peroxide Content after 4 weeks at 60° C., ppm | ≧5 | | | |

The distillate fuel according to the present invention may be manufactured at a site different from the site at which the distillate fuel is received and ultimately used commercially. Preferably, the Fischer Tropsch derived product and the petroleum derived product are manufactured or obtained at one or more remote sites (i.e., a location away from a refinery or market, which location may have a higher cost of construction than the cost of construction at the refinery or market. In quantitative terms, the distance of transportation between the remote site and the refinery or market is at least 100 miles, preferably more than 500 miles, and most preferably more than 1000 miles),and the distillate fuel is used commercially at a developed site. The Fischer-Tropsch derived product and the petroleum derived product may be manufactured or obtained at the same remote site or at different remote sites. In one embodiment, the Fischer Tropsch wax is derived from a Fischer Tropsch process at a remote site, and the petroleum derived VGO is obtained at the same remote site. The Fischer Tropsch wax and the petroleum derived VGO are blended at the remote site and hydrocracked to provide a distillate fuel as described herein. The distillate fuel is transported to a developed site and unloaded at the developed site for commercial use.

Addition of Additives

The distillate fuel of the present invention may include additives that are commonly used for diesel or jet fuels. A description of diesel fuel additives that may be used in the present invention is as described in the Chevron Corporation, *Technical Review Diesel Fuels*, pp. 55-64 (2000) and a description of jet fuel additives that may be used in the present invention is as described in Chevron Corporation, *Technical Review Aviation Fuels*, pp 27-30 (2000). In particular, these additives may include, but are not limited to, antioxidants (especially low sulfur antioxidants), lubricity additives, pour point depressants, and the like. The additives are added to the distillate fuels in a minor amount, preferably less than 1 weight %.

In particular, if necessary, the stability of a distillate fuel of the present invention can be improved by addition of an antioxidant. A good review of the general field of antioxidants for fuels is in Gasoline and Diesel Fuel Additives, Critical Reports on Applied Chemistry, Vol. 25, John Wiley and Sons Publisher, Edited by K. Owen, pages 4 to 11.

Preferably, to provide a stable low sulfur distillate fuel according to the present invention, certain sulfur-free antioxidants are added to the distillate fuel, if necessary. If necessary, the addition of the sulfur-free antioxidant should be done as soon as possible after formation of the distillate fuel according to the present invention to limit the formation of peroxides. The proper concentration of the antioxidant necessary to achieve the desired stability varies depending upon the antioxidant used, the type of fuel employed, the type of engine, and the presence of other additives. The sulfur-free antioxidant is added in an amount to provide a fuel having a reflectance as measured by ASTM D6468 of greater than 65% when measured at 150° C. for 90 minutes and a peroxide content of less than 5 ppm after storage at 60° C. for four weeks. In general the sulfur-free antioxidant is added in an amount of 5 to 500 ppm by weight, more preferably 8 to 200 ppm, and even more preferably 20 to 100 ppm.

The sulfur-free antioxidants of the present invention contain sulfur only at the impurity level. The sulfur-free antioxidants provide a fuel plus antioxidant that contains less than 1 ppm sulfur. Assuming that the fuel itself contains no sulfur and that 100 ppm of the antioxidant is used, the antioxidant contains less than 1 wt % sulfur, preferably less than 100 ppm sulfur, and even more preferably less than 10 ppm sulfur.

The sulfur-free antioxidants that are effective in the present invention are preferably selected from the group consisting of phenols, cyclic amines, and combinations thereof. Preferably, the phenols contain one hydroxyl group, but para cresols (i.e., two hydroxyl groups) are also effective. Preferably the phenols are hindered phenols.

The cyclic amine antioxidants according to the present invention preferably are cyclic amines having the following formula:

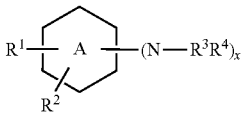

wherein:

A is a six-membered cycloalkyl or aryl ring, $R^1$, $R^2$, $R^3$, and $R^4$ are independently H or alkyl; and x is 1 or 2.

The phenol antioxidants according to the present invention preferably are alkylphenols having the formula:

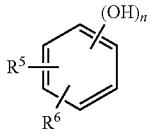

wherein $R^5$ and $R^6$ are independently H or alkyl and n is 1 or 2.

Examples of sulfur-free antioxidants according to the present invention include 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene -bis(4,6-dimethylphenol), 2,2'-methylene-bis(4-methyl-6-cyclohexylphenol), 2,6-di-tertbutyl-4-methylphenol, 2,6-di-tertbutyl-4-ethylphenol, 2,4-dimethyl-6-tert -butyl-phenol, 2,6-di-tert-butyl dimethylamino-p-cresol, 2,6-di-tert-4-(N,N'-dimethyl -aminomethylphenol), bis(3,5-di-tert-butyl-4-hydroxybenzyl), alkylated diphenylamine, phenyl-alpha-naphthylamine, alkylated-alpha-naphthylamine, and combinations thereof.

Further examples of sulfur-free antioxidants of the present invention include methylcyclohexylamine, N,N'-di-sec-butyl-p-phenylenediamine, 2,6-di-tert-butylphenol, 4-tert-butylphenol, 2-tert-butylphenol, 2,4,6-tri-tert-butylphenol, and combinations thereof.

A further example of a sulfur-free antioxidant that may be used in the present invention are amino phenols as taught in U.S. Pat. No. 4,320,021, issued Mar. 16, 1982 to R. M. Lange. The amino phenols disclosed therein have at least one substantially saturated hydrocarbon-based substituent of at least 30 carbon atoms. Similar amino phenols, which may also be used in the present invention, are disclosed in related U.S. Pat. No. 4,320,020, issued Mar. 16, 1982 to R. M. Lange. In addition, U.S. Pat. No. 3,149,933, issued Sep. 22, 1964 to K. Ley et al., discloses hydrocarbon-substituted amino phenols that may also be used in the present invention.

Further examples of amino phenols, which may be used in the present invention, are as disclosed in U.S. Pat. No. 4,386,939, issued Jun. 7, 1983 to R. M. Lange. The '939 patent discloses nitrogen-containing compositions prepared by reacting an amino phenol with at least one 3- or 4-membered ring heterocyclic compound in which the hetero atom is a single oxygen, sulfur or nitrogen atom, such as ethylene oxide. The nitrogen-containing compositions of this patent may be used in the present invention.

Nitro phenols may also be used in the present invention. Nitro phenols are disclosed, for example, in U.S. Pat. No. 4,347,148, issued Aug. 31, 1982 to K. E. Davis. The nitro phenols disclosed therein contain at least one aliphatic substituent having at least about 40 carbon atoms.

The antioxidants may be used in the present invention singly or in combination. Preferably, mixtures of antioxidants are used. Preferred sulfur-free antioxidants according to the present invention are selected from the group consisting of aryl-amines, hindered phenols, and blends thereof. Preferably, the sulfur-free antioxidant as used in the present invention is a blend of a phenol and a cyclic amine. Blends of aryl-amines and hindered phenols are especially preferred.

A distillate fuel according to the present invention containing an effective amount of a sulfur-free antioxidant will have an increase in peroxide number of less than about 5 ppm, preferably less than about 4 ppm, and even more preferably less than about 1 ppm after storage at 60° C. in an oven for 4 weeks.

If necessary to exhibit satisfactory lubrication properties, a lubricity additive may be added to the distillate fuels according to the present invention. Diesel fuel guidelines for fuel lubricity are described in ASTM D975. Work in the area of diesel fuel lubricity is ongoing by several organizations such as the International Organization for Standardization (ISO) and the ASTM Diesel Fuel Lubricity Task Force. These groups include representatives from the fuel injection equipment manufacturers, fuel producers, and additive suppliers. The charge of the ASTM task force has been the recommendation of test methods and a fuel specification for ASTM D975. ASTM D6078, a scuffing load ball-on-cylinder lubricity evaluator method, SLBOCLE, and ASTM D6079, a high frequency reciprocating rig method, HFRR, were proposed and approved as test methods. The following guidelines are generally accepted and may be used in the absence of a single test method and a single fuel lubricity value: fuels having a SLBOCLE lubricity value below 2,000 grams might not prevent excessive wear in injection equipment while fuels with values above 3,100 grams should provide sufficient lubricity in all cases. If HFRR at 60° C. is used, fuels with values above 600 microns might not prevent excessive wear while fuels with values below 450 microns should provide sufficient lubricity in all cases.

The distillate fuels of the present invention may further be blended with a non-alcohol lubricity additive to form a product with an HFRR wear scar of 450 microns or less as measured by ASTM D6079. Preferred lubricity additives are selected from the group consisting of acids and esters, with esters especially preferred, as acids can cause compatibility problems with other additives used in the lubricating oil, while esters do not.

The distillate fuels according to the present invention may meet the specifications for a diesel fuel and be used as such. Preferably, the blended diesel fuel meets specifications for a diesel fuel as defined in ASTM-975-98.

The blended diesel fuel according to the present invention is a superior diesel fuel in that it is stable and produced economically.

Blending with Other Distillate Fuel Blend Stocks

The distillate fuel according to the present invention may be used as blend stock and blended with other distillate fuel blend stocks to provide a distillate fuel suitable for use in a diesel engine or in a jet engine. The blend stock itself does not necessarily meet specifications for the respective fuel, but preferably the resulting combination of blend stocks does. Preferably, the distillate fuel blend stock according to the present invention is blended with a petroleum derived blend stock. When used as a distillate fuel blend stock, preferably the distillate fuel blend stock according to the present invention is blended with other blend stocks in an amount of greater than or equal to 10 weight percent and less than or equal to 90 weight percent.

The distillate fuel blend stock may be made by blending the blend comprising the Fischer-Tropsch derived product and the petroleum derived product with other distillate fuel blend stocks by techniques known to those of skill in the art.

The blending of the distillate fuel blend stock of the present invention with a petroleum derived distillate blend stock occurs after hydrocracking of the blend according to the present invention. If removal of polynuclear aromatics is necessary, the blending may occur after hydrocracking of the blend but prior to removing polynuclear aromatics or after removal of polynuclear aromatics but prior to use as a distillate fuel.

The following examples are given to illustrate the invention and should not be construed to limit the scope of the invention.

EXAMPLE

A Fischer-Tropsch (FT) wax was blended with petroleum derived vacuum gas oil (VGO). The resulting blend comprised 33 weight % FT wax and 67 weight % VGO. The VGO contained greater than 2,000 ppm nitrogen, a hydrocracking catalyst poison, while the blend contained less than 2,000 ppm nitrogen. Properties of the FT wax, VGO, and blend are shown in Table IV.

TABLE IV

| Stream Properties | | | |
|---|---|---|---|
| | FT Wax | VGO | Blend |
| Gravity, ° API | 40.2 | 20.9 | 27.2 |
| Sulfur, ppm | | 8,000 | 5,400 |
| Nitrogen, ppm | 3.2 | 2,498 | 1,790 |
| Wax, wt % | 100 | 7.3 | 38 |
| D2887 Distillation, wt % by ° F. | | | |
| ST/5 | 732/771 | 353/529 | 442/553 |
| 10/30 | 788/811 | 577/674 | 598/710 |
| 50 | 839 | 745 | 791 |
| 70/90 | 857/885 | 816/871 | 829/868 |
| 95/EP | 898/948 | 890/926 | 883/920 |

The blend was hydrocracked at 53.1 weight % conversion below 650° F. over a sulfided NiW/amorphous $SiO_2$—$Al_2O_3$ catalyst at 790° F., 0.5 $hr^{-1}$, 1,000 psig, and 6 MSCF/Bbl $H_2$ to preserve aromatics. Properties of the 300-650° F. diesel product distilled in 45.7% yield are shown in Table V.

TABLE V

| 300-650° F. Diesel Product Properties | |
|---|---|
| Gravity, ° API | 33.1 |
| Viscosity at 40° C., cSt | 2.322 |
| Pour Point, ° C. | −46 |
| Cloud Point, ° C. | −24 |
| Sulfur, ppm | <6 |
| Nitrogen, ppm | 0.85 |
| SFC, wt % | |
| Saturates | 56.1 |
| Aromatics | 38.1 |
| Olefins | 1.1 |
| Oxygenates | 4.6 |
| Calculated Cetane Index | 42.1 |
| Heat of Combustion, Btu/lb | 19,419 |
| Heat of Combustion, BTU/Gal | 139,001 |

TABLE V-continued

| 300-650° F. Diesel Product Properties | |
|---|---|
| Net Heat of Combustion, Btu/lb | 18,274 |
| Net Heat of Combustion, BTU/Gal | 130,805 |
| Peroxide Number, ppm | |
| Initial | 1.6 |
| Four Weeks at 60° C. | 162 |
| ASTM D6468 High Temperature Stability at 150° C. | |
| 90 minutes | 94.8 |
| 180 minutes | 98.9 |
| Sim. Dist, wt %, ° F. | |
| ST/5 | 276/324 |
| 10/30 | 356/443 |
| 50 | 513 |
| 70/90 | 570/625 |
| 95/EP | 644/677 |
| D86, LV % | |
| ST/5 | 333/364 |
| 10/30 | 381/443 |
| 50 | 492 |
| 70/90 | 536/582 |
| 95/EP | 599/631 |

The diesel product comprising the hydrocracked blend of the FT wax and the VGO is tested and has a volume increase when measured according to ASTM D 471 at 23+/−2° C. and for 70 hours in excess of 0.2% and also in excess of 1.0 wt %. These results can be achieved without the addition of aromatics to the final product from a separate stream.

A sample of the diesel product was tested and initially contained low levels of peroxides; however, peroxides formed upon storage at 60° C. for four weeks. Accordingly, it is desirable to add an effective amount of a sulfur-free antioxidant as soon as possible after formation of the diesel product to prevent formation of peroxides upon storage.

While the invention has been described in detail and with reference to specific embodiments thereof, it will be apparent to one skilled in the art that various changes and modifications can be made without departing from the spirit and scope thereof.

What is claimed is:

1. A distillate fuel comprising a hydrocracked blend of a Fischer-Tropsch derived product and a petroleum derived product, the distillate fuel comprising:

a) greater than or equal to 2 and less than 10 weight % aromatics, wherein the aromatics comprise less than 10 weight % polynuclear aromatics;

b) greater than or equal to 0.1 weight % oxygenates;

c) less than or equal to 10 ppm sulfur;

d) less than or equal to 10 ppm nitrogen; and e) greater than 90 weight % paraffins;

wherein the distillate fuel has a stability of greater than or equal to 65% according to ASTM D6468 when measured after 90 minutes at 150° C. and a cetane index of greater than or equal to 40.

2. The distillate fuel of claim 1, wherein the distillate fuel comprises 10 to 90 weight % of the Fischer-Tropsch derived product.

3. The distillate fuel of claim 1, wherein the distillate fuel comprises 30 to 50 weight % of the Fischer-Tropsch derived product.

4. The distillate fuel of claim 1, wherein the Fischer-Tropsch derived product comprises greater than or equal to 50 weight % of hydrocarbons boiling above 650° F. as determined by ASTM D2887.

5. The distillate fuel of claim 1, wherein the Fischer-Tropsch derived product comprises greater than or equal to 90 weight % of hydrocarbons boiling above 650° F. as determined by ASTM D2887.

6. The distillate fuel of claim 1, wherein the petroleum derived product comprises greater than or equal to 50 weight % of hydrocarbons boiling above 650° F. as determined by ASTM D2887.

7. The distillate fuel of claim 1, wherein the petroleum derived product comprises greater than or equal to 90 weight % of hydrocarbons boiling above 650° F. as determined by ASTM D2887.

8. The distillate fuel of claim 1, wherein the petroleum derived product comprises greater than or equal to 500 ppm nitrogen.

9. The distillate fuel of claim 1, wherein the petroleum derived product comprises greater than or equal to 2000 ppm nitrogen.

10. The distillate fuel of claim 1, wherein the distillate fuel comprises greater than or equal to 5 weight % aromatics.

11. The distillate fuel of claim 1, wherein the distillate fuel comprises greater than or equal to 0.5 weight % oxygenates.

12. The distillate fuel of claim 1, wherein the distillate fuel comprises less than or equal to 1 ppm sulfur and less than or equal to 1 ppm nitrogen.

13. The distillate fuel of claim 1, wherein the distillate fuel has a stability of greater than or equal to 80% according to ASTM D6468 when measured after 90 minutes at 150° C.

14. The distillate fuel of claim 1, wherein the distillate fuel has a stability of greater than or equal to 80% according to ASTM D6468 when measured after 180 minutes at 150° C.

15. The distillate fuel of claim 1, wherein the distillate fuel has a stability of greater than or equal to 90% according to ASTM D6468 when measured after 180 minutes at 150° C.

16. The distillate fuel of claim 1, wherein the distillate fuel has a volume change of at least 0.2% according to ASTM D471 using a nitrile O-Ring at 23 +/−2° C. for 70 hours.

17. The distillate fuel of claim 1, wherein the distillate fuel has a volume change of at least 0.5% according to ASTM D471 using a nitrile O-Ring at 23 +/−2° C. for 70 hours.

18. The distillate fuel of claim 1, wherein the distillate fuel has a volume change of at least 1.0% according to ASTM D471 using a nitrile O-Ring at 23 +/−2° C. for 70 hours.

19. The distillate fuel of claim 1, wherein the distillate fuel has a net heat of combustion of greater than or equal to 130,000 BTU/gallon according to ASTM D240.

20. The distillate fuel of claim 1, wherein the distillate fuel has a viscosity of greater than or equal to 1.3 cSt according to ASTM D445 when measured at 40° C.

21. The distillate fuel of claim 1, wherein the distillate fuel has a density of 0.775 to 0.86 g/cm$^3$ at 15° C.

22. The distillate fuel of claim 1, wherein the distillate fuel has a peroxide content of less than 5 ppm according to ASTM D3703-92 when measured after 4 weeks at 60° C.

23. The distillate fuel of claim 1, wherein the distillate fuel conforms to ASTM D975 diesel fuel specifications or to ASTM D1655 jet fuel specifications.

24. The distillate fuel of claim 1, further comprising an antioxidant.

25. The distillate fuel of claim 24 , wherein the antioxidant is a sulfur-free antioxidant and the distillate fuel has a peroxide content of <5 ppm as determined by ASTM D3703-92 when measured after 4 weeks at 60° C.

26. A distillate fuel comprising a hydrocracked blend of about 10 to 90 weight % of a Fischer-Tropsch derived product and about 10 to 90 weight % of a petroleum derived product, the distillate fuel comprising:

a) greater than or equal to 5 and less than 10 weight % aromatics; wherein the aromatics comprise less than 5 weight % polynuclear aromatics;
b) greater than or equal to 1 weight % oxygenates;
c) less than or equal to 10 ppm sulfur;
d) less than or equal to 10 ppm nitrogen; and
e) greater than 90 weight % paraffins;

wherein the distillate fuel has a stability of >65% as determined by ASTM D6468 when measured after 90 minutes at 150° C.; a net heat of combustion of >130,000 BTU/gallon as determined by ASTM D240; and a cetane index of >40.

* * * * *

UNITED STATES PATENT AND TRADEMARK OFFICE

CERTIFICATE OF CORRECTION

PATENT NO. : 7,951,287 B2
APPLICATION NO. : 11/019460
DATED : May 31, 2011
INVENTOR(S) : Stephen J. Miller et al.

It is certified that error appears in the above-identified patent and that said Letters Patent is hereby corrected as shown below:

Column 23, line 47:

delete “and less than 10”

Column 25, line 1:

delete “and less than 10”

Signed and Sealed this
Fourth Day of October, 2011

David J. Kappos

David J. Kappos
*Director of the United States Patent and Trademark Office*